US008371745B2

(12) United States Patent
Manni

(10) Patent No.: US 8,371,745 B2
(45) Date of Patent: Feb. 12, 2013

(54) TWO-FUNCTION CONTROLLING DEVICE FOR A WRIST COMPUTER OR ALIKE AND METHOD FOR CONTROLLING A WRIST COMPUTER OR SUCHLIKE TERMINAL

(75) Inventor: Jukka Manni, Helsinki (FI)

(73) Assignee: Suunto Oy, Vantaa (FI)

( * ) Notice: Subject to any disclaimer, the term of this patent is extended or adjusted under 35 U.S.C. 154(b) by 507 days.

(21) Appl. No.: 12/650,303

(22) Filed: Dec. 30, 2009

(65) Prior Publication Data

US 2010/0187074 A1 Jul. 29, 2010

(30) Foreign Application Priority Data

Dec. 31, 2008 (FI) ..... 20086259

(51) Int. Cl.
*G04B 29/00* (2006.01)

(52) U.S. Cl. ..... 368/319; 368/308; 368/306

(58) Field of Classification Search ..... 368/321, 368/319–320

See application file for complete search history.

(56) References Cited

U.S. PATENT DOCUMENTS

| | | | | |
|---|---|---|---|---|
| 3,526,088 | A * | 9/1970 | Meitinger | 368/161 |
| 4,031,341 | A | 6/1977 | Wuthrich et al. | |
| 4,415,277 | A | 11/1983 | Ganter | |
| 4,419,018 | A | 12/1983 | Meyrat | |
| 4,536,095 | A | 8/1985 | Wuthrich et al. | |
| 4,773,051 | A | 9/1988 | Soltermann | |
| 4,785,434 | A * | 11/1988 | Shoji et al. | 368/185 |
| 5,305,291 | A | 4/1994 | Kamens et al. | |
| 5,521,890 | A * | 5/1996 | Miche et al. | 368/319 |
| 5,959,267 | A | 9/1999 | Kawasaki et al. | |
| 6,203,190 | B1 | 3/2001 | Stotz | |
| 6,227,700 | B1 | 5/2001 | Hunziker et al. | |
| 7,111,977 | B2 * | 9/2006 | Hiranuma et al. | 368/289 |
| 7,272,077 | B2 * | 9/2007 | Nobs | 368/69 |
| 7,318,670 | B2 * | 1/2008 | Cretin | 368/308 |
| 2003/0103413 | A1 | 6/2003 | Jacobi, Jr. et al. | |
| 2005/0050718 | A1 | 3/2005 | Kaelin et al. | |
| 2005/0207285 | A1 | 9/2005 | Omori et al. | |

FOREIGN PATENT DOCUMENTS

| | | |
|---|---|---|
| EP | 0 805 380 A1 | 11/1997 |
| FI | 100489 | 12/1997 |
| JP | 49-71966 A | 7/1974 |
| JP | 2007-071748 | 3/2007 |

* cited by examiner

*Primary Examiner* — Sean Kayes

(74) *Attorney, Agent, or Firm* — Birch, Stewart, Kolasch & Birch, LLP

(57) ABSTRACT

The invention pertains to a double-acting control element for a wrist-top computer, comprising a crown, which can be moved in axially and radially, a reaction bar, connected to the and parallel to a crown's rotational axis. The reaction bar is arranged to transmit the movements of the crown from outside to the inside of a case. Switches are permanently fitted to the inside of the case. An axial switch is arranged to switch on from the axial movement of the crown. A radial switch is arranged to switch on from the radial movement of the crown. A slide, at least partly inside the case, is arranged to transmit the axial movement of the reaction bar to the axial switch and a gearwheel. The gearwheel is arranged to link the reaction bar to the slide to transmit the radial movement to the radial switch.

22 Claims, 4 Drawing Sheets

TWO-FUNCTION CONTROLLING DEVICE FOR A WRIST COMPUTER OR ALIKE AND METHOD FOR CONTROLLING A WRIST COMPUTER OR SUCHLIKE TERMINAL

The present invention relates to the control of at least in part digital terminal device. In particular, the invention relates to control mechanisms for digital terminal devices, such as wristwatches or heart-rate meters, by means of which the device can be controlled, by operating only a single button, either pressing or rotating it.

Digital, or at least partly digital terminal devices, such as wristop computers and wristwatches, heart-rate meters, compasses, and GPS receivers, have traditionally been controlled using means that create digital control signals. The control devices for the said devices usually contain some form of user interface that can be moved, such as a crown or button, to which a press switch is directly connected, or to which a set of levers is connected, by means of which it is possible to operate several multistage switches. Particularly in devices in a higher price bracket, which aim at absolute reliability, control is implemented by using a crown on the side of the device, by means of which elements inside the device are operated, the positions of which are changed to create different pairs of contacts with the aid of contact studs soldered to the device's circuit board. For example, a device is known from publication U.S. Pat. No. 6,203,190 B1, which comprises a moveable crown, which can be both pressed and rotated. In the construction according to the publication, the crown has a shaft, to which a gearwheel is attached, which is arranged to operate a bendable contact foot, with the aid of which various contact pairs can be implemented on a nearby circuit board, either by moving the shaft longitudinally, or by rotating it. In addition, control devices based on optics are known.

However, significant drawbacks are associated with the prior art. This is because the known reliable control structures are very difficult to manufacture, due to their precision-engineered components, such a contact feet. Conventional control-element constructions contains a large number of sheet-metal parts manufactured as sheet-metal work, the fitting of which into small terminal devices, such as diving watches, is labour-intensive, which increases the costs of the product. In addition, the sheet-metal parts are usually very thin and easily fatigue when bent in use, causing the reliability of the structure to suffer. Optical control devices have offered a partial solution to structures with disadvantageous costs, but optical control devices are not suitable, for example, for use in heart-rate meters, as they consume a great deal of power and this require a separate power switch. The large number of switches means that the case of the terminal device cannot be sealed optimally.

The invention is intended to eliminate at least some of the problems referred to above and create an improved double-acting control element and control method for a wristop computer or similar.

The two-axis control element according to the invention comprises a crown, which can be moved axially and radially relative to the case of the terminal device and at least partly outside of it, and a reaction bar, which connects to the crown parallel to its axial direction, in such a way that the reaction bar is arranged to transmit the movements of the crown to the interior of the case. The control element comprises, in addition, switches, which are permanently fitted inside the case and at least one of which, an axial switch, is arranged to connect from the axial movement of the crown and at least another, radial switch, is arranged to connect from the radial movement of the crown. The control element also includes a slide that is at least partly inside the case, which connects to the reaction bar in such a way that the slide is arranged to transmit the axial movement of the reaction bar to the axial switch. A gearwheel inside the case is fitted around the slide, in such a way that the toothed wheel is arranged to link the reaction bar to the slide to transmit the radial movement to the radial switch.

In the control method according to the invention, in order to control a wristop computer or similar terminal device, a crown outside the terminal device is rotated in order to browse values, which values are shown on the digital display of the terminal device, the rotational movement of the crown being transmitted to a lever switch inside the terminal device by deflecting its angle lever using a radial claw of the axial element linking to the crown. In the method, the crown is also pressed inwards to select a desired value, the pressing movement of the crown being transmitted mechanically to a press switch inside the terminal device by deflecting it using of the axial element connecting to the crown.

Considerable advantages are gained with the aid of the invention. This is because the control element according to the device can be assembled easily and quickly, as the construction does not require the use of precision-engineered sheet-metal parts. Thanks to the slide of the control element and the gearwheel fitted around it by means of a sliding-form fit, the crown can be used to make settings axially and radially allowing the terminal device to be controlled easily and comprehensively using only a single control element. The small number of parts in the control element means that the construction is additionally extremely robust, while the fatiguing wear characteristic of the thin sheet-metal parts of the prior art does not affect the components. Thanks to its mechanical construction, the control element consumes no power at rest, which is a significant advantage over optical-control elements. In the construction according to the invention, no separate switch is needed to switch on the control element on. In addition, each component can be manufactured using methods suitable for large manufacturing batches.

According to one embodiment of the invention, the control element can be used to operate only one switch at a time, so that when the crown of the control element is pressed, it cannot cause unintentional settings based on rotational movement.

According to one embodiment, the switches of the control element are surface mounted on a circuit board, allowing most of the assembly of the control element to be automated, thus leading to cost savings over traditional labour-intensive assembly.

According to one embodiment, the control element comprises a key body to be attached to the case of the terminal device, which has a sealing collar and flange, as well as sealing rings placed in them, by which the construction can be made extremely watertight, allowing the terminal device to be used, for example, deep under water, or in otherwise wet conditions.

In the following, the invention is examined in greater detail and with reference to the accompanying drawings.

Figure 1:
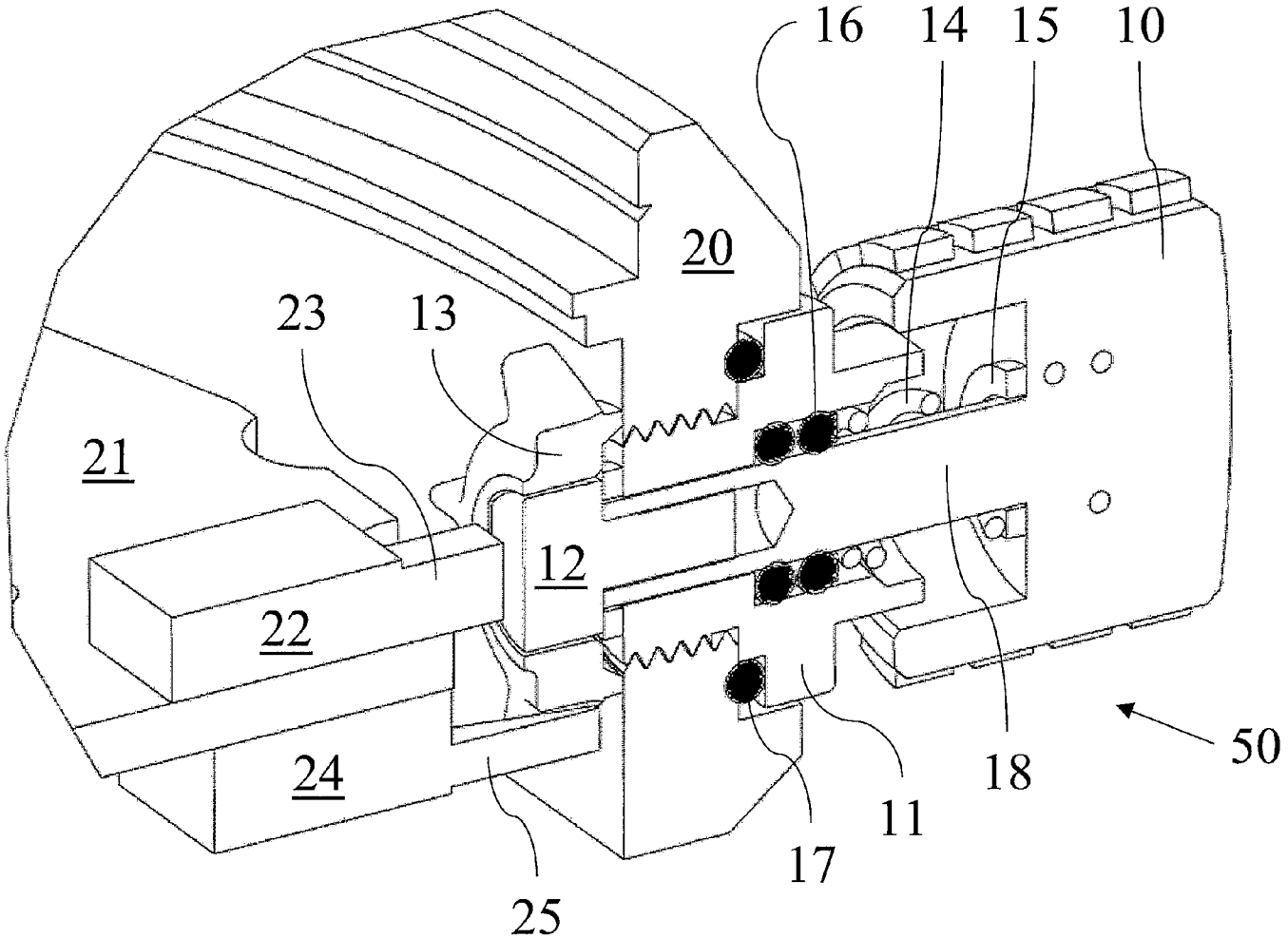
FIG. 1 shows a cutaway assembly view of the control element according to the invention.

As can be seen from FIG. 1, the control device 50 according to the invention is arranged to control at least parts of a digital terminal device. The terminal device can be, for example, a wristwatch of wristop computer, or even a compass. The terminal device to be controlled is at least partly digital, as the switches 22 and 24 used to control it can conventional switches used in digital devices, which are installed on a circuit board 21. The signals created by the switches 22 and 24 can be used to control a fully digital device, or they can be used to control devices, such as actuators producing mechanical movement. In any event, the terminal device has a case 20, inside which the switches 22 and 24 are installed. In the case 20, there is an opening, in which there is preferably a screw-down backplate (not shown) and through which the device's circuit board along with its components and other parts can be assembled and through which the device's battery can be changed. There is a groove in the backplate, in which a sealing ring (not shown) is installed, which seals the backplate opening. The switches 22 and 24 inside the case are preferably surface-mounted on a circuit board 21, so that assembly is rapid and can easily be automated with sufficient positioning accuracy. Generally, the switches 22 and 24 are in either a conducting or a non-conducting state, depending on their position. Further, in the present application the term switch refers to, for instance, operating elements, which can convert mechanical movement into an electrical signal, typically as individual pulses, or as a change in voltage level.

Figure 2:
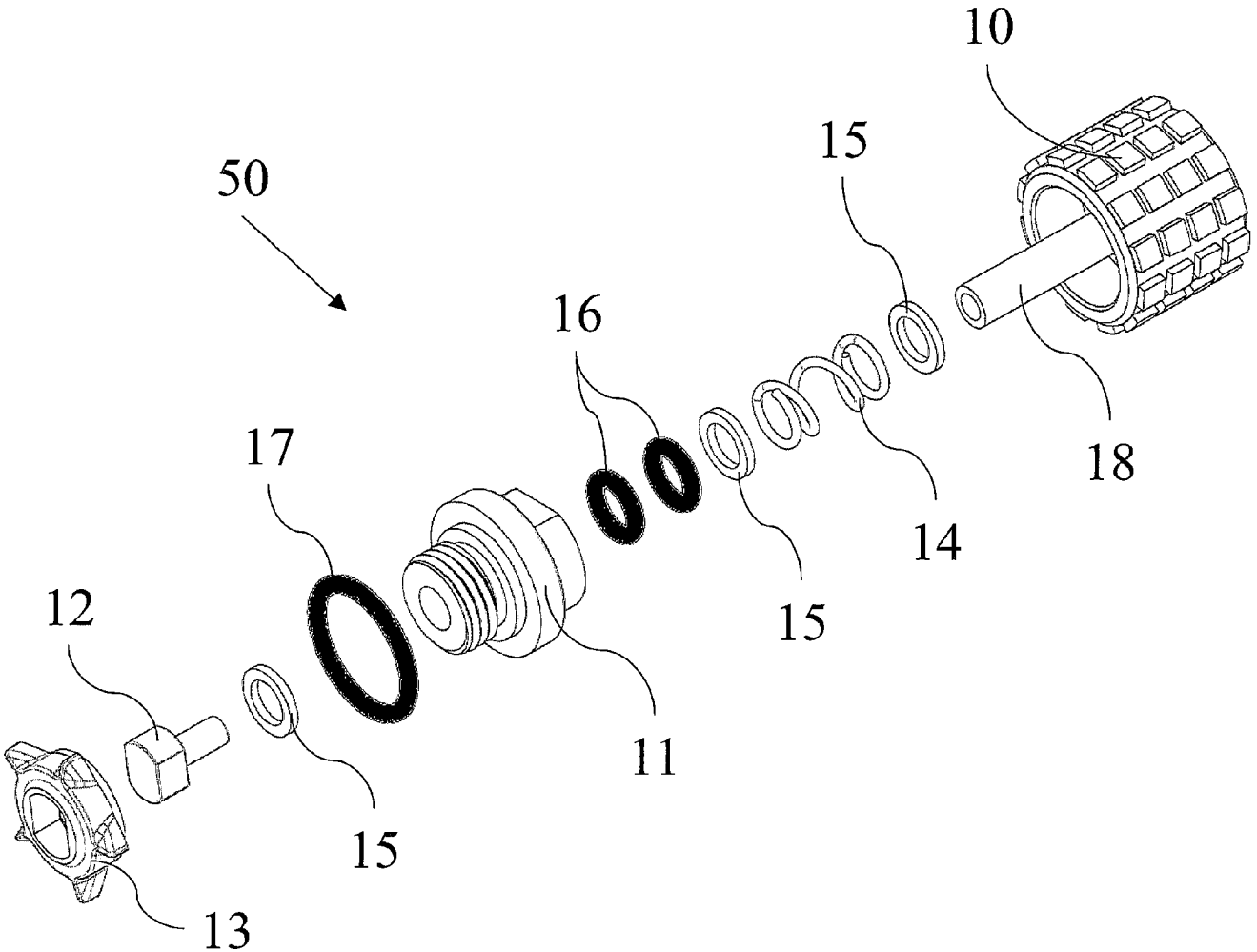
FIG. 2 shows an exploded view of the control element according to the invention, without the switches.

A threaded through-hole is made in the case 20 of the terminal device for the parts of the control element 50, so that the switches 22 and 24 inside the case 20 can be operated from outside the case 20. A key body 11, a portion of which is naturally equipped with a corresponding thread, is screwed into the through-hole in the case 20. The key body 11 is a part of the control element 50, and is attached tightly to the case 20 of the terminal device, its task being to connect the control device 50 to the terminal device and seal the adapter between them, as well as to proportion the control movements to the case 20 of the terminal device. The key body 11 has a through hole, into which a reaction bar 18 is fitted, using a slide adapter or a loose slide adapter, allowing the reaction bar 18 to be moved in the through hole in the key body 11. The reaction bar 18 extends from outside the case 20 of the terminal device through the case into its interior and has the task of transmitting control movements outside the case 20 into the case 20. In this connection, the terms inside and outside refer correspondingly to the internal and external directions of the case 20. A crown 10, which acts as the user interface of the control element 50, is attached to the external end of the reaction bar 18. The crown 10 is preferably a cylindrical and knurled or otherwise grooved steel part, which the user can rotate or press to easily control the terminal device. The physical dimensions of the crown 10 are typically such that it is suitable for being rotated between the ends of the user's fingers. The cylindrical reaction bar 18 and the crown 10 are concentric. The crown 10 and the reaction bar 18 can alternatively also be integrated to form one and the same part (FIG. 2), which can be made, for example, by turning using a bar-type automatic lathe. The fixed connection between the crown 10 and the reaction bar 18 allows the movements made outside the case 20 to be transmitted inside the terminal device. The diameter of the reaction bar 18 is usually less than the outer diameter of the crown 10, so that the crown 10 can be pressed to the bottom against the counter-collar of the key body 11, as will be examined in greater detail hereinafter.

As stated, the crown 10 is cylindrical and its outer jacket is preferably knurled, to increase friction when the crown 10 is rotated. An annular groove is made in the end of the crown 10 next to the terminal device, around the reaction bar 18. In other words, the reaction bar 18 is attached to the bottom of a hole larger than the cross-sectional profile of the reaction bar 18, in the centre of the crown 10. The annular groove in the crown 10 is dimensioned in such a way that when the crown 10 is pressed inwards, the external collar-like portion of the key body 11 remains between the crown 10 and the reaction bar 18. In the key body 11, there is a counter-collar, which acts as a mechanical stop to the crown 10, so that when the crown 10 is pressed inwards, its internal surface bottoms out on the counter-collar of the key body 11. The counter-collar simultaneously acts as a sealing flange. A gap remains between the sealing flange of the key body 11 and the case 20, into which a sealing ring 17 is inserted. The sealing flange is essentially parallel to the corresponding outer surface of the case 20, which ensures that the sealing ring 17 is pressed evenly against the surfaces when the key body is screwed into the case 20. The term essentially parallel means that, when the key body 11 is screwed into the case 20, their opposing surface are sufficiently parallel that the sealing ring 17 is not stretched longer than its original dimension.

A sealing collar, which is at right angles to the reaction bar 18 on the side of the key body 11 next to the crown 10, is also made in the key body 11. Thus, except for the slide adapter between the key body 11 and the reaction bar 18, there is a gap for sealing and springing between the parts. At least one and preferably two sealing rings 17 are installed around the reaction bar 18 against the sealing collar. The sealing rings 17 are preferably rubber O rings, which seal onto the slide adapter between the reaction bar 18 and the key body 11, so that moisture cannot enter the terminal device through the adapter. A spring 14, the internal end of which lies against the sealing rings 17 and the external end of which lies on the bottom of the groove surrounding the reaction bar 18 of the crown 10, is installed in the same gap. A skid washer 15, the task of which is to act as a sliding surface when the crown 10 is rotated, is fitted to each end of spring 14. The skid washers 15 are preferably of steel or some other wear-resistant material. Thus, by means of the key body 11 attached to it and the spring 14, the crown 10 is sprung against the case 20 of the terminal device, so that the crown 10 is made to return when pressed inwards.

A slide 12 is attached to the internal end of the reaction bar 18. According to one embodiment, a threaded hole is made in the internal end of the reaction bar 18, into which the slide 12, equipped with a corresponding thread, is screwed. According to another embodiment, the joint between the reaction bar 18 and the slide is implemented as a keyed joint. According to the invention, the joint is in any event permanent, due to which the control movements acting on the crown 10 are arranged to be transmitted through the reaction bar 18 to the slide 15. Generally, the term slide 15 refers in the present application to an axial extension of the reaction bar 18 or the crown 10, which is fixed to the reaction bar 18 or is a separately attached part in the crown 10, which is arranged to connect to a switch inside the case 20, as described hereinafter. The portion of the slide 12 inside the case 20 is dimensioned in such a way that it is at least somewhat larger in diameter than the through hole in the key body 11, so that the slide 12 will remain inside the case 20, when the spring force of the spring 14 forces the crown outwards from the case 20. Thus, the spring force of the spring 14 pushes the crown 10 outwards from the case 20, which is opposed by the diameter of the slide 12 which is larger than that of the through hole in the key body 11. Thanks to this, a linear counter-pressure is created in the crown 10, which increases operating comfort.

As stated, the crown 10 is arranged to be pressed inwards towards the case 20 of the terminal device. In this connection, movement parallel to the pressing of the crown 10, i.e. parallel to the longitudinal axis of the reaction bar 18, is referred to as an axial movement, which takes place in an axial direction. According to the invention, the axial movement of the crown 10 is transmitted through the reaction bar 18 to the slide 12, which transmits the movement to a press switch 22 inside the case 20 of the terminal device, which is referred to in this connection as an axial switch. The axial switch 22 is preferably a basic component of the electronics industry, which is attached by the surface-mounting method to the circuit board 21, which is permanently attached to the case 20. The control element according to the invention is preferably equipped with a quite thin axial switch 22, so that when mounted on the circuit board it will fill inside even a flat terminal device. The typical thickness of the axial switch 22 is 1 . . . 2 mm, its other sides being about 4 . . . 5 mm in length. The axial switch 22 is also preferably light in operation, so that a user can easily select, for example, a value they have browsed, without rotating the crown 10, and can be easily attached to the circuit board 21, so that its assembly and soldering can be automated. The light operation of the switch can be defined by the magnitude of the force required to deflect the press button 23 of the axial switch 22 to the connecting position, which should preferably be about 1 . . . 3 N, preferably about 1.5 . . . 2 N. Correspondingly, the form of attachment of the axial switch 22 is such that it has as few feet as possible, preferably two, to be soldered and positioned on the circuit board 21. Thus, the mounting of the axial switch 22 on the circuit board 21 can be easily automated and assembly can be performed as robotized surface mounting, which is particularly economical with large production series. As stated, the axial switch 22 is, in type, a press switch widely used in the electronics industry; such as appear, for example, in digital cameras and mobile telephones. An axial switch 22 like that described can be, for example, an ALPS SPEE120100-model electronics component.

The circuit board 21 and the axial switch 22 attached to it are arranged relative to the case 20 in such a way that the press button 23 is parallel to the path of movement of the one-way slide 15 and that the extreme length of the axial movement of the crown 10 is sufficient to operate the press button 23. The axial switch 22 can have two positions, so that it is either on or off, or it can have many, for example four, consecutive axial positions. According to one preferred embodiment, the axial switch 22 has three positions, so that only two of the three positions are used. The use of a three-position switch as a two-position switch is advantageous in operating environments of the device, in which possible strong impacts can strike the crown 10. Strong impacts on the device can be caused by, for example, the device hitting the ground when it falls. However, such impacts must not cause the switch 22 to bottom out, because in that case it might detach from its soldering. Thus, according to one embodiment, the control element 50 is equipped with a sufficiently long travel on the axial switch 22, which does not have a conductive state, as well as two conductive states, depending on how deeply the crown 10 is pressed. According to the embodiment, only the first connection is used while the remainder of the travel is reserved as a safety area for tolerance variation, which ensures that the axial switch 22 cannot bottom out under any conditions. Another alternative is to equip the space between the slide 12 and the axial switch 22 with an elastic plastic cushion, which acts as a shock absorber. However, this construction is not as robust as the previous embodiment, due to the larger number of parts and thus is not as reliable in operation.

Figure 3:
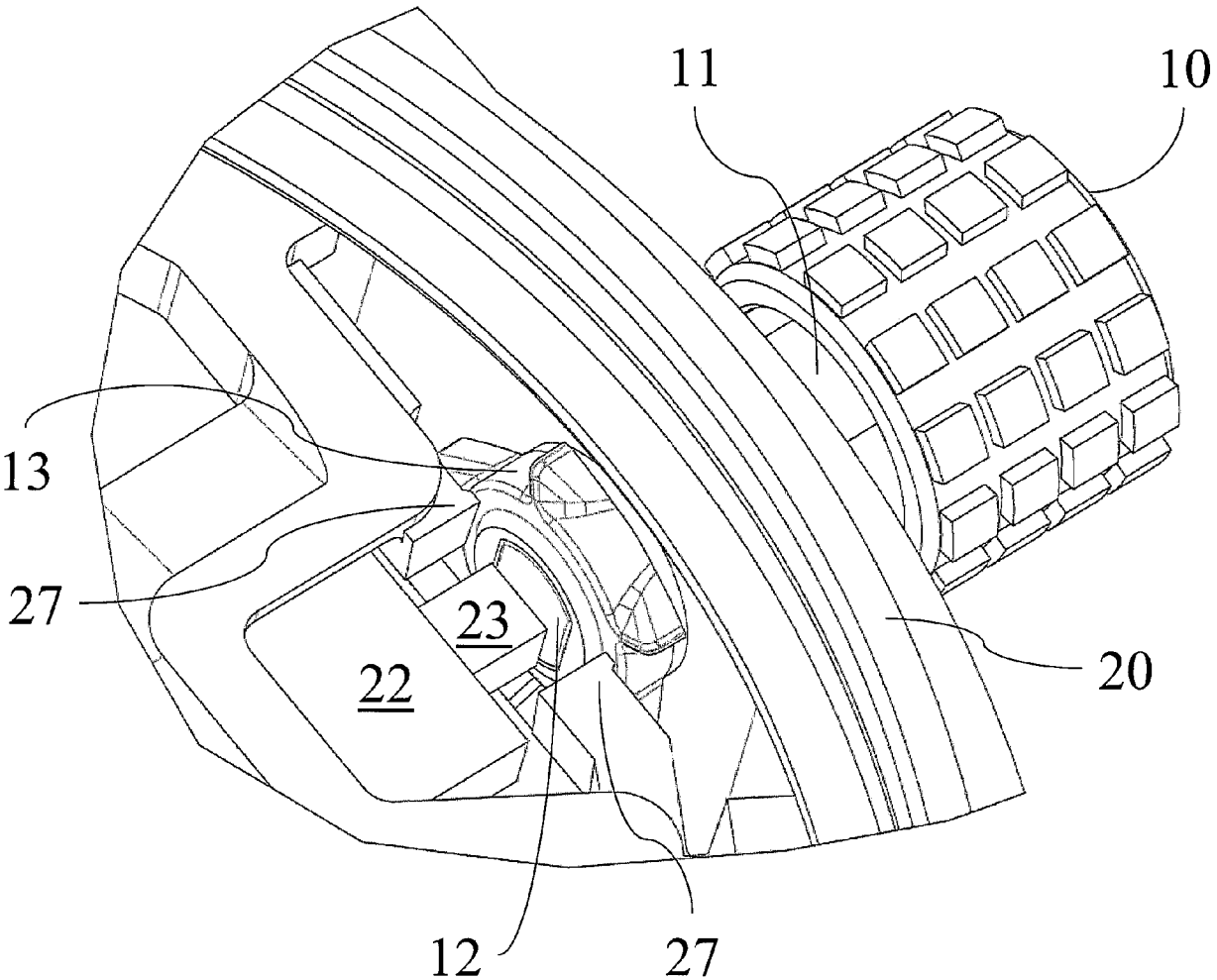
FIG. 3 shows a control element according to the invention, which is installed in a cutaway watch.
Figure 4:
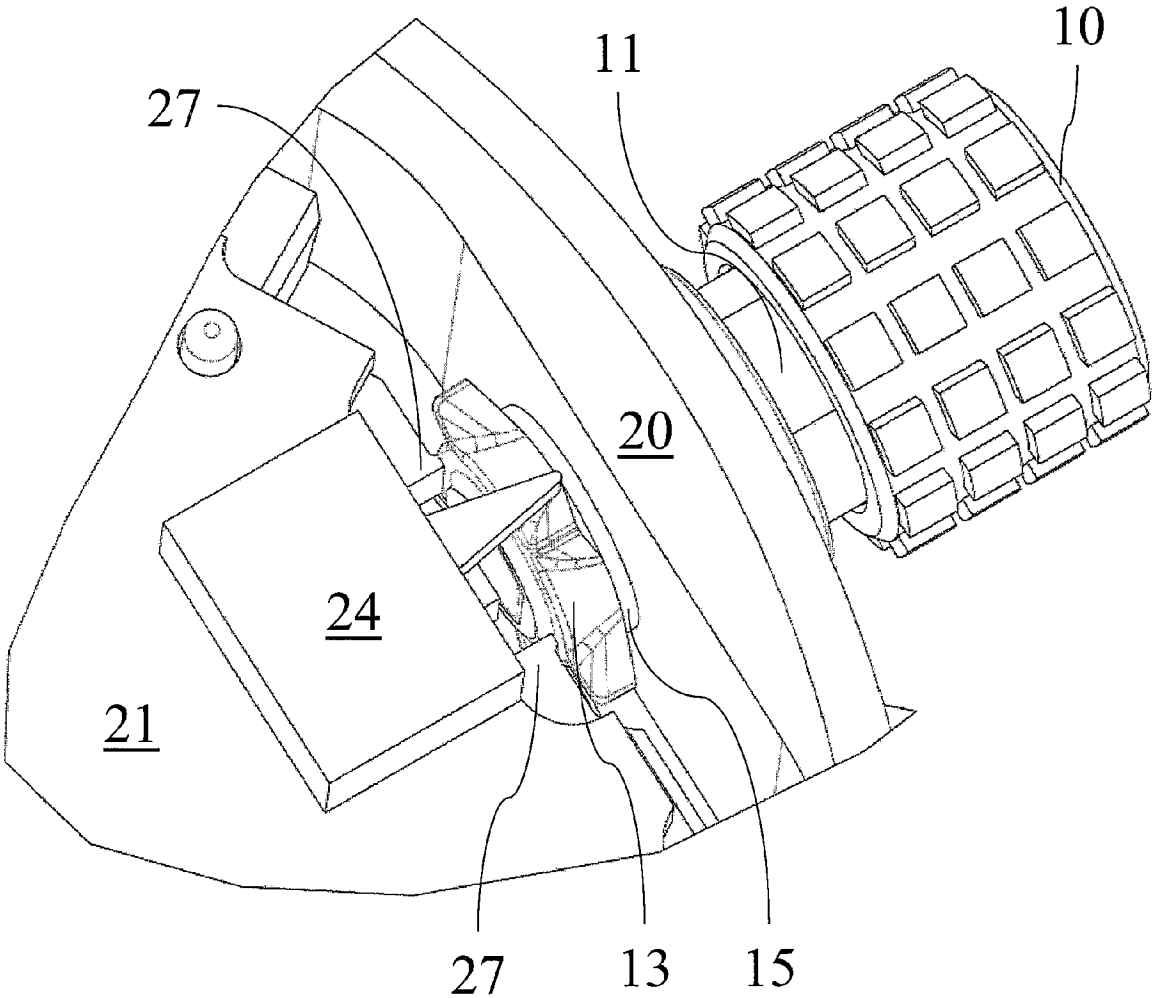
FIG. 4 shows the control device according to FIG. 3, seen from the obverse side of the cutaway watch.

A gearwheel 13 is fitted around the portion of the slide 12 inside the case 20. The gearwheel 13 according to the invention can be, for instance, an annular piece, which has an internal hole and a number of radial detents protruding form its outer edge, or a cogwheel like a dog clutch. As can be seen from FIG. 2, there is a shape fit between the slide 12 and the gearwheel 13 connected to it. The portion of the slide 12 inside the case 20 is preferably shaped with an angular cross-section, in which case a corresponding shape also appears in the through-hole in the middle of the gearwheel 13. In addition, the adapter between the slide 12 and the gearwheel 13 is dimensioned as a sliding fit, by which the slide is arranged to slide in the hole in the gearwheel during its axial movement. In other words, a sliding-shape fit prevails between the slide 12 and the gearwheel, which allows sliding to take place between the pieces in the longitudinal direction of the reaction bar 18, but not in its rotational direction, so that the slide 12 can either slide in the hole in the gearwheel 13, or rotate the gearwheel 13. As can be seen from FIGS. 3 and 4, one or more retainer claws 27 are fitted inside the case 20, which press the gearwheel 13 against the internal surface of the case 20. The retainer claw 27 can be, for example, part of the support structure of the circuit board 21, as shown in the embodiments of FIGS. 3 and 4. The retainer claw 27 ensures that the gearwheel 13 remains in position, in such a way that the claw lies against the flat surface of the gearwheel 13. Alternatively, the gearwheel 13 is preferably equipped with an annular groove, in which the retainer claw 27 can be supported, without sliding off the internal surface of the gearwheel 13 (not shown). Thus, by means of the control element 50 according to the invention, at a single time either pressing or rotating movements can be made, which is especially advantageous if the rotational movement of the crown 10 is used to browse values, which are selected by a pressing movement of the crown 10. The retainer claw thus ensures that the setting movements can be made separately.

The sliding fit must be taken into account when selecting the material of the slide 12 and the gearwheel 13. The slide 12 is preferably manufactured from steel and the gearwheel 13 from a polymer, such as polyacetal. As stated, the crown 10 according to the invention is also arranged to be able to be moved rotationally. In this connection, the rotational movement of the crown 10, i.e. the rotational movement taking place around the longitudinal axis of the reaction bar 18, is referred to as a radial movement, which thus takes place in a radial direction. When the crown 10 is rotated radially, the rotational movement is transmitted by the reaction bar 18 to the slide 12 that is permanently connected to it. Because of the rotational movement, the interface between the slide 12 and the internal surface of the key body 11 is also equipped with a skid washer 15, which facilitates movement and reduces wear. Thanks to the shape fit between the slide 12 and the gearwheel 13, the radial movement is transmitted to the gearwheel 13, so that this is arranged to rotate in a fixed manner along with the crown 10.

The gearwheel 13 transmits the radial movement of the crown 10 to the switch 24 on the inner side of the case 20, which in this connection is referred to as a radial switch, by pushing the tooth of the gearwheel 13 to the connected position of the angle lever 25 of the switch 24. The radial switch 24 is preferably a lever switch known as a basic component in electronics, which is surface mounted on the circuit board 21, in such a way that its angle lever 25 is arranged in the path of motion of the teeth of the gearwheel 13. At the same time, the location of the radial switch 24 inside the case 20 is dimensioned in such a way that the extent of the movement of the gearwheel 13 is sufficient to operate the radial switch 24. The position of the radial switch 24 relative to the gearwheel 13 is dimensioned in such a way that the connection in both directions is certain, but the angle lever 25 itself may not move as far as the stop, as otherwise this would cause excessive wear between the angle lever 25 and the gearwheel 13. This could also be felt in the user's fingers when rotating. According to one embodiment, the radial switch 24 can be operated in either direction, i.e. the terminal device can be controlled by rotating the crown 10 either clockwise or counterclockwise. Like the axial switch 22, the radial switch 24 is preferably quite thin, so that it will fit inside even a flat terminal device when mounted on the circuit board. The typical thickness of the radial switch 24 is 1 . . . 2 mm, its other sides being about 4 . . . 5 mm in length. The radial switch 24 is also light in operation, so that the user can easily browse values without rotating the crown 10, and easily attached to the circuit board 21, so that its assembly and soldering can be automated. The lightness of operation of the switch can be defined by the magnitude of the force required to move its angle lever 25 to a conductive switching position, which should be at most about 1 N, preferably at most about 0.3 . . . 0.4 N. Correspondingly, the ease of installation of the radial switch 24 should be such that it has as few feet as possible to be placed on the circuit board 21, these being preferably two at most. Thus, the mounting of the radial switch 24 on the circuit board 21 can easily be automated and assembly can be performed as robotized surface mounting, which is especially advantageous with large production series. As stated, the radial switch 24 is a lever switch of a type widely using in the electronics industry, such as appears, for example, in digital video cameras and portable audio players. A radial switch 24 like that described can be, for example, an ALPS SSCM120100-model electronic component. Generally, both switches contain several parts, but the component switches suitable for use according to the invention have traditionally been extremely reliable and are therefore suitable, together with the crown 10 according to the invention with the parts connected to it, for replacing conventional precision-engineered constructions.

The radial switch 24 is preferably such that it makes a response sound, such as a click, when it is operated. The response-sound functionality helps the user to know also aurally when the setting made using the rotational movement of the crown 10 has succeeded. In practical terms, the control element 50 is designed to be used with the processor of the terminal device, so that a change in state taking place on the display of the terminal device also takes place when the radial switch 24 returns to a non-conductive state, i.e. to the free central position. In this way, the click of the switch is timed simultaneously with the change in display state, which is important in terms of operating experience.

Thus, by means of the construction according to the invention, a terminal-device control element 50 is created, with the aid of which the terminal device can be controlled by pressing or rotating a crown 10, i.e. the control element is double-acting. The control device 50 according to the invention can also be implemented in such a way that the portion of the control device that can be moved, or part of it, is integrated as a single component. This is because the crown 10 and the reaction bar 18 can be a single structure, which is manufactured, for example, by turning from a steel billet, or by die-casting. The slide 12 and the gearwheel 13 too can be cast, for example, as a single solid part. In this case, the gearwheel 13 will move along with the slide 12 when this moves axially. Alternatively, some combination of the aforementioned parts, for example the reaction bar 18 and the slide 12 can be manufactured as a single part. According to one embodiment, the crown 10, the reaction bar 18, slide 12, and the gearwheel 13 are all of the same piece, which is produced, for example, by machining or precision casting. In that case, the case 20 of the terminal device must be made such that the combined structure can be assembled in the terminal device and the case 20 is tight. According to yet another embodiment, there is no separate key body 11 in the control element 50, but instead the control element 50 is attached directly to the case 20 of the terminal device. According to the embodiment without a key body, the integrated part 10, 12, 13, 18 of the control element 50 is installed in a hole, which is made in the case 20, or between the case 20 and the screwed backplate (not shown), in which case the seal of the backplate will also seal the integrated part 10, 12, 13, 18 with the case 20.

An example of a practical operating situation of the control element 50 is a case, in which the crown 10, which can be pressed or rotated, of a wristwatch or heat-rate meter is used to set an alarm time. For example, the desired hours are sought by rolling and rotating the crown 10 radially, when the hour will change on the display always when the angle lever 25 of the radial switch 24 deflected by the gearwheel 13 clicks into the central position. The desired hour is acknowledged by pressing the crown 10 axially, when the press button 23 of the axial switch 22 deflects to the connecting position pushed by the slide 12, which results in an automatic move to the minute selection, in which the same is done for the minutes.

In the method according to the invention, in order to set a wristwatch, wristop computer, or similar terminal device, an external crown 10 according to the above description is rotated, when the numbers to be set, shown on the digital display of the terminal device, change according to the steps of the rotation of the crown 10. When the crown 10 is rotated, this rotational movement is transmitted mechanically to a lever switch 24, i.e. to a radial switch as described above, inside the terminal device. Thus, according to the method, the lever switch 24 is operated using the crown 10 by deflecting the lever switch 24 by a radial claw of the axial element 18 connecting the switch's angle lever 25 to the crown 10, in other words by a detent, such as a tooth of the gearwheel 13, arranged in connection with the reaction bar 18 connecting to the crown 10. Once the desired value has been obtained by rolling the rotation of the known 10, this value is selected by pressing the crown 10 inwards, i.e. axially. The pressing movement of the crown 10 is transmitted mechanically to the press switch 22 inside the terminal device, i.e. the axial switch as described above. Thus, according to the invention, the press switch 22 is operated by deflecting it by the axial element 18 connecting its button 23 to the crown 10, or by a separate hammer part 12, i.e. slide as described above, connecting to this. According to one embodiment of the invention, the rotational movement of the crown 10 is transmitted to an electronic component acting as a lever switch 24, mounted on the circuit board inside the terminal device. Correspondingly, according to one embodiment, the pressing movement of the crown 10 is transmitted to an electronic component acting as a press switch 22 mounted on the circuit board inside the terminal device.

REFERENCE-NUMBER LIST

| Part number | Part |
|---|---|
| 10 | crown |
| 11 | key body |
| 12 | slide |

-continued

| Part number | Part |
|---|---|
| 13 | gearwheel |
| 14 | spring |
| 15 | skid washer |
| 16 | sealing ring |
| 17 | sealing ring |
| 18 | reaction bar |
| 20 | case |
| 21 | circuit board |
| 22 | press switch |
| 23 | button |
| 24 | lever switch |
| 25 | angle lever |
| 27 | retainer claw |

The invention claimed is:

1. A double-acting control element for a wristop computer, which has a case, which control element comprises:

a crown, which is movable in an axial and radial direction relative to the case of the terminal device and at least partly outside thereof, a reaction bar, which connects to the crown parallel to its axial direction, in such a way that the reaction bar is arranged to transmit the movement of the crown inside the case, switches, which are fixed inside the case, of which switches at least one, an axial switch, is arranged to engage from the axial movement of the crown, and at least another, a radial switch, is arranged to engage from the radial movement of the crown, a slide, which is at least partly inside the case and which connects to the reaction bar, in such a way that the slide is arranged to transmit the axial movement of the reaction bar to the axial switch, and a gearwheel, which is inside the case, and which gearwheel is fitted around the slide by means of a sliding-form fit, in such a way that the gearwheel is arranged to transmit the radial movement, transmitted by the reaction bar to the slide, to the radial switch.

2. The control element according to claim 1, wherein the axial switch is a press switch, which has a press key, which is arranged to switch on in the axial direction of the crown.

3. The control element according to claim 1, wherein the axial switch is a press switch, which is an electronic component.

4. The control element according to claim 1, wherein the radial switch is a lever switch, which has an angle lever, which is arranged to intermesh with a tooth of the gearwheel, due to the radial movement of the crown.

5. The control element according to claim 1, wherein the radial switch is two-way.

6. The control element according to any claim 1, wherein the radial switch is a lever switch, which is an electronic component.

7. The control element according to claim 1, wherein the switches are attached to a circuit board, which is permanently fitted to the case.

8. The control element according to claim 7, wherein the switches are surface-mounted on the circuit board.

9. The control element according to claim 1, wherein the control element further comprising a key body, which has a hole for a reaction bar and which is fixed to the case, in such a way that the key body is fitted between the case and the reaction bar, in such a way that the key body is at least partly between the case and the crown.

10. The control element according to claim 9, wherein there is a sealing collar in the key body around the reaction-bar hole, in such a way that in the assembly the sealing collar is on the other side of the key body to the gearwheel.

11. The control element according to claim 10, wherein the control element comprises a spring, which is fitted around the reaction bar, between the sealing collar of the key body and the crown.

12. The control element according to claim 10, wherein the control element comprises at least one sealing ring, which is fitted between the sealing collar and the spring.

13. The control element according to claim 12, wherein the control element comprises two sealing rings, which are fitted between the sealing collar and the spring.

14. The control element according to claim 9, wherein there is a threaded portion in the key body, with the aid of which the key body can be screwed into the case, and which is concentric with the reaction-bar hole.

15. The control element according to claim 9, wherein the key body has a sealing flange, which is essentially parallel to the outer surface of the case.

16. The control element according to claim 9, wherein the control element comprises a sealing ring, which is fitted between the case and the sealing flange of the key body.

17. The control element according to claim 9, wherein the control element comprises a sliding washer, which is fitted between the slide and opposing surfaces of the key body.

18. The control element according to any claim 9, wherein the control element comprises a sliding washer, which is fitted between an outermost sealing ring and the spring.

19. The control element according to claim 9, wherein the control element comprises a sliding washer, which is fitted between the spring and opposing surfaces of the crown.

20. The control element according to claim 1, wherein the gearwheel is of polymer.

21. The control element according to claim 1, wherein the gearwheel is of polyacetal.

22. Double-acting control element for a wristop computer or similar, which has a case, the control element comprising:

a crown, which is movable in an axial and radial direction relative to the case of the terminal device and at least partly outside thereof;

a reaction bar, which connects to the crown parallel to its axial direction, in such a way that the reaction bar is arranged to transmit the movement of the crown inside the case;

switches, which are fixed inside the case, of which switches at least one, an axial switch, is arranged to engage from the axial movement of the crown, and at least another, a radial switch, is arranged to engage from the radial movement of the crown, wherein the switches are surface-mounted components on a circuit board which is permanently fitted to the case;

a slide, which is at least partly inside the case and which connects to the reaction bar, in such a way that the slide is arranged to transmit the axial movement of the reaction bar to the axial switch; and a gearwheel, which is inside the case, and which gearwheel is fitted around the slide by means of a sliding-form fit, in such a way that the gearwheel is arranged to transmit the radial movement, transmitted by the reaction bar to the slide, to the radial switch.

* * * * *